US009162688B2

(12) United States Patent
Gotou

(10) Patent No.: US 9,162,688 B2
(45) Date of Patent: Oct. 20, 2015

(54) VIBRATIONAL COMPONENT ACCELERATION ESTIMATION DEVICE AND VIBRATIONAL COMPONENT ACCELERATION ESTIMATION METHOD FOR RAILWAY VEHICLE

(75) Inventor: Osamu Gotou, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 302 days.

(21) Appl. No.: 13/818,112

(22) PCT Filed: Aug. 22, 2011

(86) PCT No.: PCT/JP2011/004646

§ 371 (c)(1),
(2), (4) Date: Feb. 21, 2013

(87) PCT Pub. No.: WO2012/026103

PCT Pub. Date: Mar. 1, 2012

(65) Prior Publication Data

US 2013/0158754 A1 Jun. 20, 2013

(30) Foreign Application Priority Data

Aug. 25, 2010 (JP) ..... 2010-188368

(51) Int. Cl.

| | |
|---|---|
| ***G05D 1/00*** | (2006.01) |
| ***G06F 7/00*** | (2006.01) |
| ***B61F 99/00*** | (2006.01) |
| ***B61F 5/22*** | (2006.01) |
| ***B61F 5/24*** | (2006.01) |

(52) U.S. Cl.
CPC . *B61F 99/00* (2013.01); *B61F 5/22* (2013.01); *B61F 5/245* (2013.01)

(58) Field of Classification Search
USPC ..... 701/19
See application file for complete search history.

(56) References Cited

FOREIGN PATENT DOCUMENTS

| | | |
|---|---|---|
| JP | 6-107172 | 4/1994 |
| JP | 6-278606 | 10/1994 |
| JP | 9-263241 | 10/1997 |
| JP | 2000-351368 | 12/2000 |
| JP | 2004-182000 | 7/2004 |
| JP | 2006-315519 | 11/2006 |
| JP | 2009-40081 | 2/2009 |
| JP | 2009-40083 | 2/2009 |
| JP | 2009-78758 | 4/2009 |
| JP | 2009-78759 | 4/2009 |

*Primary Examiner* — Bhavesh V Amin
(74) *Attorney, Agent, or Firm* — Clark & Brody

(57) ABSTRACT

A device for estimating the acceleration of a vibrational component acting on a vehicle body in a lateral direction when a railway vehicle having a vehicle body tilting device runs in a curve section includes a sensor for detecting the acceleration acting on the vehicle body in a lateral direction, a calculation unit for acquiring track information at a running point, a running speed, and ON/OFF information of vehicle body tilting operation, and calculating a theoretical excess centrifugal acceleration αL acting on the vehicle body by equations, and a calculation unit for deriving the acceleration of the vibrational component acting on the vehicle body based on the acceleration detected by the sensor and the acceleration αL determined by the calculation unit. Vibration generated in the vehicle body in a lateral direction is suppressed, so that the acceleration of the vibrational component can be estimated.

4 Claims, 4 Drawing Sheets

| RUNNING POINT | SECTION TYPE | CURVATURE DIRECTION | CURVATURE RADIUS R | CANT AMOUNT C | GAUGE G | EASEMENT CURVE PATTERN |
|---|---|---|---|---|---|---|
| 0 ~ 100m | STRAIGHT SECTION | - | - | 0mm | 1435mm | - |
| ~ 500m | EASEMENT CURVE ENTRY SECTION | + (PLUS) | ∞ ~ 4000m | 0mm ~ 155mm | 1435mm | SINE HALF-WAVELENGTH DIMINISHING CURVE |
| ~ 2500m | STEADY-STATE CURVE SECTION | + (PLUS) | 4000m | 155mm | 1435mm | - |
| ~ 2900m | EASEMENT CURVE EXIT SECTION | + (PLUS) | 4000m ~ ∞ | 155mm ~ 0mm | 1435mm | SINE HALF-WAVELENGTH DIMINISHING CURVE |

FIG. 3

| RUNNING POINT | SECTION TYPE | CURVATURE DIRECTION | CURVATURE RADIUS R | CANT AMOUNT C | GAUGE G | EASEMENT CURVE PATTERN |
|---|---|---|---|---|---|---|
| 0 ~ 100m | STRAIGHT SECTION | - | - | 0mm | 1435mm | - |
| ~ 500m | EASEMENT CURVE ENTRY SECTION | + (PLUS) | ∞ ~ 4000m | 0mm ~ 155mm | 1435mm | SINE HALF-WAVELENGTH DIMINISHING CURVE |
| ~ 2500m | STEADY-STATE CURVE SECTION | + (PLUS) | 4000m | 155mm | 1435mm | - |
| ~ 2900m | EASEMENT CURVE EXIT SECTION | + (PLUS) | 4000m ~ ∞ | 155mm ~ 0mm | 1435mm | SINE HALF-WAVELENGTH DIMINISHING CURVE |

FIG. 4
(a)
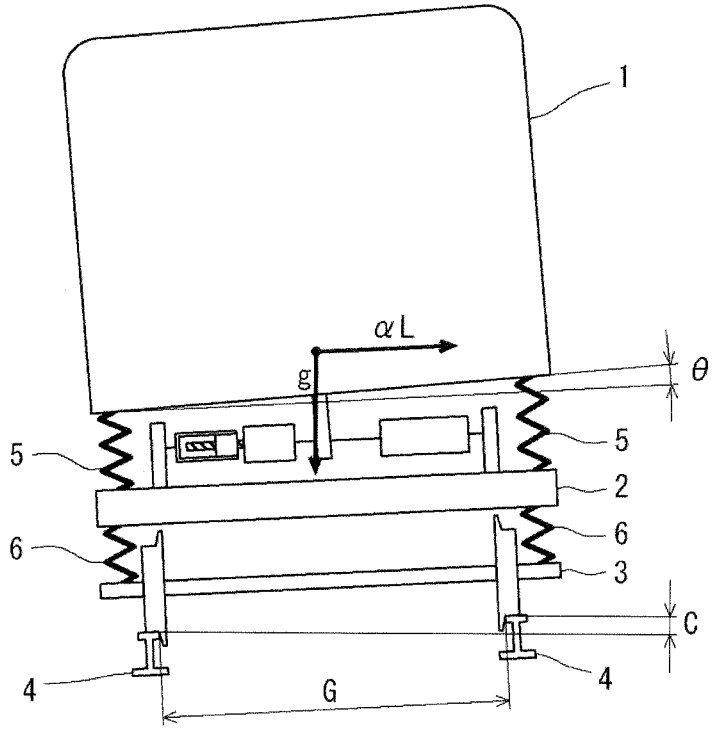
(b)
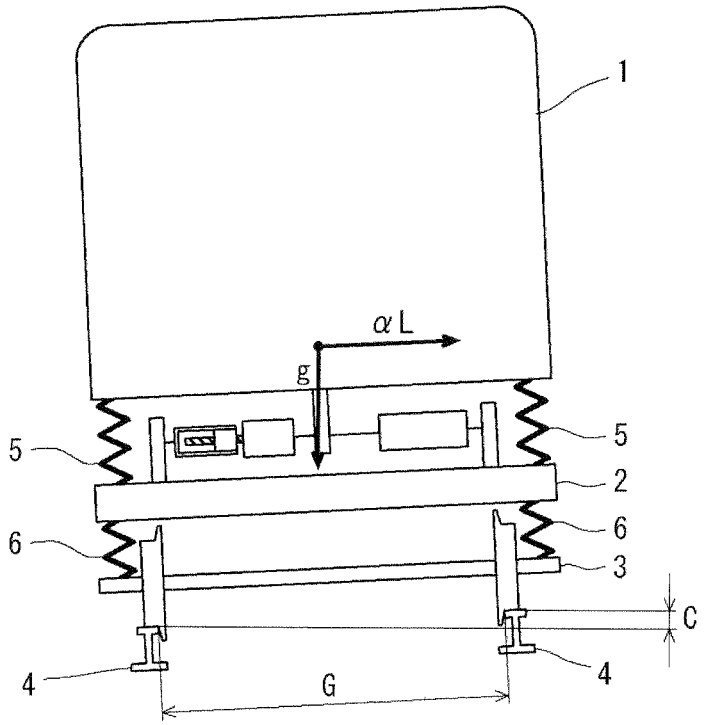

VIBRATIONAL COMPONENT ACCELERATION ESTIMATION DEVICE AND VIBRATIONAL COMPONENT ACCELERATION ESTIMATION METHOD FOR RAILWAY VEHICLE

TECHNICAL FIELD

The present invention relates to a device and a method for estimating the acceleration of a vibrational component acting on a vehicle body in a lateral direction when a railway vehicle runs in a curve section, particularly to a vibrational component acceleration estimation device and a vibrational component acceleration estimation method for a railway vehicle suitable for the case where the railway vehicle has a vehicle body tilting device.

BACKGROUND ART

In a railway vehicle like a Shinkansen bullet train, during running, in association with the imposition of various types of vibration acceleration such as swaying and rolling, a vibration in a lateral direction is generated. Since the vibration deteriorates riding comfort, a vibration suppression device is mounted in a general railway vehicle, so that an air cushion, a coil spring, a damper, and/or the like are disposed between a vehicle body and a bogie truck to absorb the impact that the vehicle body receives from the bogie truck, and an actuator capable of extending and retracting in a lateral direction is disposed to attenuate the vibration of the vehicle body.

As the actuator, a fluid pressure type actuator with pneumatic pressure or hydraulic pressure as a drive source, an electric actuator with electric power as a drive source, and the like are adopted. In the actuator, a main body is coupled to any one of the bogie truck side and the vehicle body side, and a movable rod is coupled to the other side. By detecting the acceleration acting on the vehicle body in a lateral direction by an acceleration sensor and by extending and retracting a rod in association with the detected acceleration, the actuator causes the vehicle body to vibrate and at the same time, adjusts a damping force of the actuator to attenuate the vibration.

When the railway vehicle runs in a curve section, not only a vibrational component for generating the vibration in the vehicle body but also a steady-state component steadily acting on the vehicle body attributable to a centrifugal force is superimposed on the acceleration detected by the acceleration sensor. Thus, when extension/retraction motion of the actuator is controlled based on only an output from the acceleration sensor, there is a risk that the vibration of the vehicle body cannot effectively be suppressed.

As a technique for solving this problem in the background art, for example, PATENT LITERATURE 1 discloses a vibrational component acceleration estimation device and a vibrational component acceleration estimation method for, with a damper capable of changing a damping force for suppressing a vibration of a vehicle body being adopted, estimating the acceleration of a vibrational component acting on the vehicle body in order to perform skyhook semi-active control to the damper when a railway vehicle runs in a curve section.

The estimation device disclosed in PATENT LITERATURE 1 includes a detection means for detecting the acceleration acting on the vehicle body in a lateral direction, a theoretical excess centrifugal acceleration calculation means for determining a theoretical excess centrifugal acceleration $\alpha L$ acting on the vehicle body in a lateral direction based on track information at a running point of the railway vehicle and a running speed of the railway vehicle, and a vibration acceleration calculation means for determining the acceleration of the vibrational component acting on the vehicle body based on the acceleration detected by the detection means and the theoretical excess centrifugal acceleration $\alpha L$ determined by the theoretical excess centrifugal acceleration calculation means. In the estimation device and the estimation method disclosed in PATENT LITERATURE 1, determining the theoretical excess centrifugal acceleration $\alpha L$ is differently performed between the case where the railway vehicle is provided with a vehicle body tilting mechanism having a vehicle body tilting device for tilting the vehicle body relative to a bogie truck and the case where the railway vehicle is a non-tilting vehicle having no vehicle body tilting device, and the following Equation (a) or (b) is used.

In a case with the vehicle body tilting mechanism:

$$\alpha L = D \times (V^2/R - g \times C/G \times \beta - g \times \theta) \quad \text{(a)}$$

in a case of the vehicle body free of tilting function:

$$\alpha L = D \times (V^2/R - g \times C/G \times \beta) \quad \text{(b)}$$

wherein in the above Equations (a) and (b), D represents a positive or negative sign showing the direction of curvature, V denotes a running speed, R denotes a curvature radius of the track, g denotes gravitational acceleration, C denotes a cant amount of the track, G denotes a track gauge, $\beta$ denotes a curve coefficient, and $\theta$ denotes a tilting angle of the vehicle body relative to the bogie truck.

CITATION LIST

Patent Literature

PATENT LITERATURE 1 Japanese Patent Application Publication No. 2009-40081

SUMMARY OF THE INVENTION

Technical Problem

However, in the estimation device and the estimation method disclosed in PATENT LITERATURE 1, in a case of the railway vehicle having the vehicle body tilting device, the above Equation (a) is used for determining the theoretical excess centrifugal acceleration. Thus, many reference parameters are required and the equations are complicated. Therefore, there is a need for a large-capacity memory for storing a large number of parameters, so that the system configuration becomes complicated and large-scaled.

An object of the present invention, which has been achieved in view of the circumstances above, is to provide a vibrational component acceleration estimation device and a vibrational component acceleration estimation method for a railway vehicle capable of estimating the acceleration of a vibrational component acting on a vehicle body in a lateral direction with a simple system configuration in order to suppress a vibration generated in the vehicle body in a lateral direction when the railway vehicle having a vehicle body tilting device runs in a curve section.

Solution To Problem

As a result of repeated running tests of an actual vehicle and examination of a vibration suppression level by variously changing an equation of a theoretical excess centrifugal acceleration $\alpha L$ in a curve section in order to achieve the above object, the present inventor found that in the case where the vehicle body tilting device is operated, as long as a proper correction coefficient is set in the equation of the theoretical excess centrifugal acceleration αL, a vibration suppression effect is almost unchanged even without strictly considering a vehicle body tilting angle θ. It is assumed that it is because, since the vehicle body tilting angle θ is as small as about 2° at maximum and a running speed V to operate the vehicle body tilting device is as fast as for example 275 [km/h] or more in a case of a Shinkansen bullet train, an influence of the vehicle body tilting angle θ is much smaller than that of the running speed V upon calculating the theoretical excess centrifugal acceleration αL.

The present invention is achieved based on such findings, and the summaries thereof lie in a vibrational component acceleration estimation device for a railway vehicle shown in the following (1), and a vibrational component acceleration estimation method for a railway vehicle shown in the following (2).

(1) The present invention is directed to a vibrational component acceleration estimation device for a railway vehicle for estimating the acceleration of a vibrational component acting on a vehicle body in a lateral direction when the railway vehicle having a vehicle body tilting device runs in a curve section, including: an acceleration detection means for detecting the acceleration acting on the vehicle body in a lateral direction; a theoretical excess centrifugal acceleration calculation means for acquiring track information at a running location of the railway vehicle, a running speed of the railway vehicle, and ON/OFF information of vehicle body tilting operation, and calculating a theoretical excess centrifugal acceleration αL acting on the vehicle body in a lateral direction based on the following Equation (1) or (2); and a vibration acceleration calculation means for deriving the acceleration of the vibrational component acting on the vehicle body based on the acceleration detected by the acceleration detection means and the theoretical excess centrifugal acceleration αL determined by the theoretical excess centrifugal acceleration calculation means, in the case where the vehicle body tilting operation is turned ON:

$$\alpha L=\eta_{ON}\times(V^2/R-g\times C/G) \quad (1)$$

in the case where the vehicle body tilting operation is turned OFF:

$$\alpha L=\eta_{OFF}\times(V^2/R-g\times C/G) \quad (2)$$

where in the above Equations (1) and (2), $\eta_{ON}$ and $\eta_{OFF}$ denote correction coefficients, V denotes a running speed, R denotes a curvature radius of the track, g denotes gravitational acceleration, C denotes a cant amount of the track, and G denotes a track gauge.

In the above estimation device, it is preferable for the vibration acceleration calculation means to calculate a difference between the acceleration detected by the acceleration detection means and the theoretical excess centrifugal acceleration αL determined by the theoretical excess centrifugal acceleration calculation means to derive the acceleration of the vibrational component.

In the above estimation device, it is preferable for the vibration acceleration calculation means to further process a signal indicating the derived acceleration of the vibrational component through a high-pass filter.

(2) The present invention is also directed to a vibrational component acceleration estimation method for a railway vehicle for estimating the acceleration of a vibrational component acting on a vehicle body in a lateral direction when the railway vehicle having a vehicle body tilting device runs in a curve section, including: an acceleration detection step for detecting the acceleration acting on the vehicle body in a lateral direction; a theoretical excess centrifugal acceleration calculation step for acquiring track information at a running point of the railway vehicle, a running speed of the railway vehicle, and ON/OFF information of vehicle body tilting operation, and calculating a theoretical excess centrifugal acceleration αL acting on the vehicle body in a lateral direction based on the following Equation (1) or (2); and a vibration acceleration calculation step for deriving the acceleration of the vibrational component acting on the vehicle body based on the acceleration detected in the acceleration detection step and the theoretical excess centrifugal acceleration αL determined in the theoretical excess centrifugal acceleration calculation step, in the case where the vehicle body tilting operation is turned ON:

$$\alpha L=\eta_{ON}\times(V^2/R-g\times C/G) \quad (1)$$

in the case where the vehicle body tilting operation is turned OFF:

$$\alpha L=\eta_{OFF}\times(V^2/R-g\times C/G) \quad (2)$$

where in the above Equations (1) and (2), $\eta_{ON}$ and $\eta_{OFF}$ denote correction coefficients, V denotes a running speed, R denotes a curvature radius of the track, g denotes gravitational acceleration, C denotes a cant amount of the track, and G denotes a track gauge.

In the above estimation method, it is preferable for, in the vibration acceleration calculation step, a difference between the acceleration detected in the acceleration detection step and the theoretical excess centrifugal acceleration αL determined in the theoretical excess centrifugal acceleration calculation step to be calculated to derive the acceleration of the vibrational component.

In the above estimation method, it is preferable for, in the vibration acceleration calculation step, a signal indicating the derived acceleration of the vibrational component to be further processed through a high-pass filter.

Advantageous Effects of Invention

According to the vibrational component acceleration estimation device and the vibrational component acceleration estimation method for a railway vehicle of the present invention, even in the case where the vehicle body tilting is performed when the railway vehicle runs in a curve section, the equation without referring to a vehicle body tilting angle (above Equation (1)) is used to determine a theoretical excess centrifugal acceleration for suppressing the vibration generated in the vehicle body in a lateral direction. Thus, in comparison to the equation in the background art (the aforementioned Equation (a)), the vehicle body tilting angle can be removed from parameters, and the equation can be simplified. Therefore, a required capacity of a memory for storing the parameters can be reduced, so that the system configuration is simplified. The acceleration of the vibrational component acting on the vehicle body can be precisely derived based on the calculated theoretical excess centrifugal acceleration, and vibration suppression of the vehicle body can be realized by using the derived acceleration.

BRIEF DESCRIPTION OF DRAWINGS

FIG. 3 is a table showing an example of a map in which track information is associated with running points.

FIG. 4 are schematic views each showing the state of the railway vehicle running in a curve section; whereas FIG. 4(*a*) shows a case where vehicle body tilting operation is turned ON, and whereas FIG. 4(*b*) shows a case where the vehicle body tilting operation is turned OFF.

DESCRIPTION OF EMBODIMENTS

Hereinafter, an embodiment of a vibrational component acceleration estimation device and a vibrational component acceleration estimation method for a railway vehicle of the present invention will be described in detail.

Figure 1:
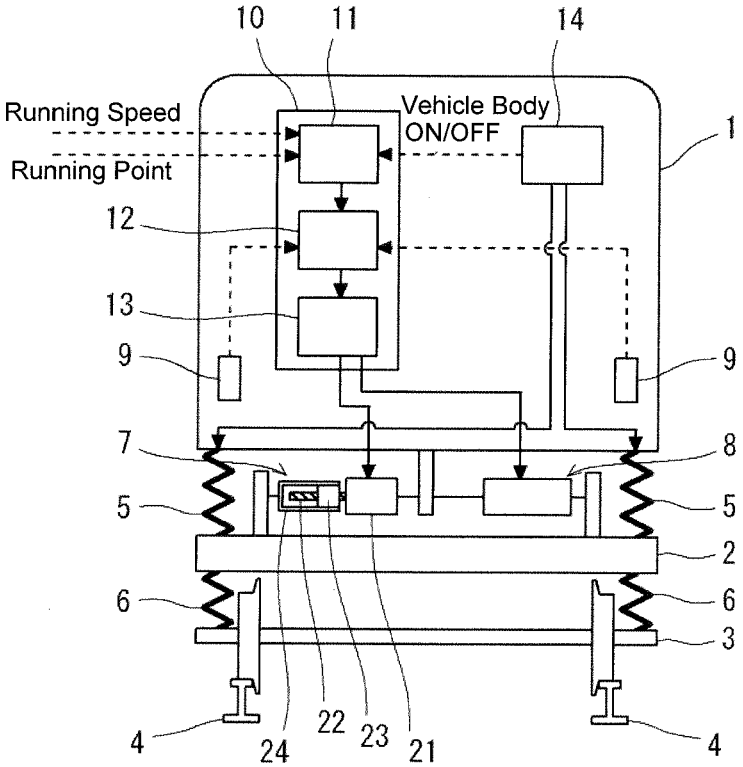
FIG. 1 is a schematic view showing a configuration example of a railway vehicle in which a vibrational component acceleration estimation device of the present invention is mounted.

FIG. 1 is a schematic view showing a configuration example of the railway vehicle in which the vibrational component acceleration estimation device of the present invention is mounted. As shown in the figure, a vehicle in the railway includes a vehicle body 1, and a bogie truck 2 supporting the vehicle body 1 at front and rear sides thereof, and runs on rails 4. The vehicle body 1 is elastically supported by air cushions 5 disposed between the vehicle body and the bogie truck 2, and the bogie truck 2 is resiliently supported by axle springs 6 disposed between the bogie truck and an axle 3. Between the bogie truck 2 and the vehicle body 1, an actuator 7 capable of extending and retracting in a lateral direction of the vehicle is provided.

The actuator 7 shown in FIG. 1 is an electric actuator in which threaded grooves are formed in a main shaft 22 of an electric motor 21 on the main body side, a ball screw nut 23 is screwed onto the main shaft 22, and a rod 24 in a coaxial manner to the main shaft 22 is fixed to the ball screw nut 23. In the actuator 7, one end on the side of the electric motor 21 is coupled to the vehicle body 1 of the railway vehicle, and the other end on the side of the rod 24 is coupled to the bogie truck 2 of the railway vehicle.

Between the bogie truck 2 and the vehicle body 1, a fluid pressure damper 8 capable of changing a damping force is disposed in parallel with the actuator 7. At four corners in front behind left and right in the vehicle body 1, acceleration sensors 9 for detecting the vibration acceleration acting on the vehicle body 1 in a lateral direction are installed.

Further, a vibration suppression controller 10 for controlling operations of the actuator 7 and the fluid pressure damper 8 and commanding the control of vibration suppression is installed in the vehicle body 1. The vibration suppression controller 10 includes a theoretical excess centrifugal acceleration calculation unit 11, a vibration acceleration calculation unit 12, and a vibration control unit 13. The theoretical excess centrifugal acceleration calculation unit 11 acquires track information at a running point of the railway vehicle, a running speed of the railway vehicle, and ON/OFF information of vehicle body tilting operation, and calculates a theoretical excess centrifugal acceleration $\alpha L$ acting on the vehicle body 1 in a lateral direction. The vibration acceleration calculation unit 12 derives the acceleration of a vibrational component acting on the vehicle body 1 based on the acceleration detected by the acceleration sensors 9 and the theoretical excess centrifugal acceleration $\alpha L$ determined by the theoretical excess centrifugal acceleration calculation unit 11. The vibration control unit 13 sends out an activation signal for mainly controlling the operation of the actuator 7 based on the vibrational component acceleration that is output from the vibration acceleration calculation unit 12.

During the running of the vehicle, in the actuator 7, in accordance with the vibrational component acceleration acting on the vehicle body 1, through a command from the vibration suppression controller 10, a rotation angle of the main shaft 22 of the electric motor 21 is controlled. Thereby, rotation motion of the main shaft 22 of the electric motor 21 is converted into linear motion by a ball screw mechanism and the rod 24 is extended and retracted, so that the actuator 7 can cause the vehicle body 1 to vibrate and at the same time, adjust the damping force of the actuator so as to attenuate the vibration. At this time, the fluid pressure damper 8 also causes a vibration damping effect.

The railway vehicle shown in FIG. 1 has a vehicle body tilting device, and the vehicle body 1 can be tilted relative to the bogie truck 2 by differentiating inner pressures of the left and right air cushions 5 at the time of running in a curve section at high speed. Control of vehicle body tilting is independent from the control of the vibration suppression, and performed by a command from a vehicle body tilting controller 14 which is different from the vibration suppression controller 10.

In the above example, although the electric actuator is used as the actuator 7, a fluid pressure type actuator can also be used.

Hereinafter, there will be described a specific mode of processing by the vibration suppression controller 10 when the railway vehicle runs.

Figure 2:
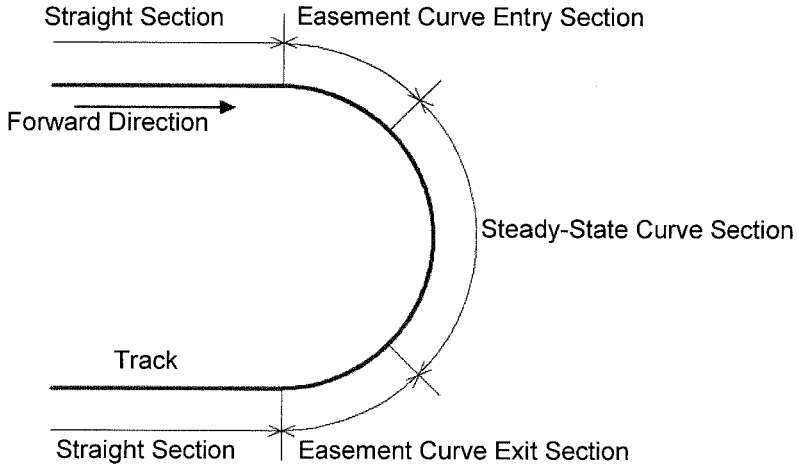
FIG. 2 is a schematic view showing the track including a curved section as an example of the track on which the railway vehicle runs.

FIG. 2 is a schematic view showing the track including a curve section as an example of the track on which the railway vehicle runs. As shown in the figure, in the track in which a straight section, the curve section, and another straight section continue in the order written along the direction of the forward movement of the vehicle, in the curve section, transition sections as having easement curve are respectively provided on the entry side and the exit side of a steady-state curve section in order to smoothen transition between the straight section and the steady-state curve section of which curvature radius is constant. The easement curve section is positioned between the straight section and the steady-state curve section of which curvature radii and cant amounts are different from each other, and continuously gradually changes a curvature radius and a cant amount to smoothly connect the straight section and the steady-state curve section.

For example, the curvature radius of the easement curve section on the entry side (hereinafter, referred to as the "easement curve entry section") is infinite at the start point as being connected to the straight section. However, the curvature radius gradually becomes nearer to the curvature radius of the steady-state curve section along with the travel of the vehicle, and coincides with the curvature radius of the steady-state curve section at a border therewith. On the contrary to the easement curve entry section, the easement curve section on the exit side (hereinafter, referred to as "easement curve exit section") has the same curvature radius as the steady-state curve section at the beginning. However, the curvature radius gradually increases along with the travel of the vehicle and becomes infinite at a border with the straight section.

As the track of the easement curve section, a clothoid curve or a sine half-wavelength diminishing curve is used. The track of the clothoid curve is a curve track of which curvature radius increases or decreases in proportion to a running distance of the easement curve section, and is frequently used in ordinary railway lines. The track of the sine half-wavelength diminishing curve is a curve track of which curvature radius is changed to draw a sine curve with respect to a running distance of the easement curve section, and is frequently used in a Shinkansen bullet train.

FIG. 3 is a table showing an example of a map in which track information is associated with running points. The above theoretical excess centrifugal acceleration calculation unit 11 has the map in which the track information is associated with the running points in a memory of the unit. The track information registered in the map includes, as shown in FIG. 3, the type of a running section (such as the easement curve entry section, the easement curve exit section, the steady-state curve section, and the straight section), the direction of curvature of the curve section, the curvature radius of the steady-state curve section, the cant amount of the curve section, and a curvature pattern of the easement curve section (such as the clothoid curve and the sine half-wavelength diminishing curve).

The theoretical excess centrifugal acceleration calculation unit 11 obtains a running position of the vehicle by transmission from a vehicle monitor (not shown) for monitoring and recording the running point, the speed of the railway vehicle, and the like, performs in reference to the above map, and recognizes in which section the vehicle is running from the corresponding track information. At the same time, the theoretical excess centrifugal acceleration calculation unit 11 acquires the running speed of the railway vehicle. Further, the theoretical excess centrifugal acceleration calculation unit 11 acquires ON/OFF information of the vehicle body tilting operation from the vehicle body tilting controller 14, and recognizes whether or not the vehicle body tilting is performed.

It should be noted that the information of the running point can be acquired not only from the vehicle monitor but also by for example GPS or the like. The running speed of the vehicle can be acquired through transmission from a vehicle information controller (not shown) mounted in for example a first vehicle or by way of calculating it using the received speed pulses in the vibration suppression controller 10. The ON/OFF information of the vehicle body tilting operation can be acquired through transmission directly from the vehicle body tilting controller 14 or via the above vehicle information controller. In the case where the vibration suppression controller 10 also serves as the vehicle body tilting controller 14, the acquisition operation can be performed within the vibration suppression controller 10 itself.

FIG. 4 are schematic views each showing the state of the railway vehicle running in a curved section. FIG. 4(*a*) shows the case where the vehicle body tilting operation is turned ON, and FIG. 4(*b*) shows the case where the vehicle body tilting operation is turned OFF. In the case where the railway vehicle runs in the curved section, that is, the easement curve entry section, the steady-state curve section, or the easement curve exit section, the above theoretical excess centrifugal acceleration calculation unit 11 refers to various acquired information, and calculates the theoretical excess centrifugal acceleration αL acting on the vehicle body 1 in a lateral direction based on the following Equation (1) or (2).

In the case where the vehicle body tilting operation is turned ON:

$$\alpha L=\eta_{ON}\times(V^2/R-g\times C/G) \quad (1)$$

in the case where the vehicle body tilting operation is turned OFF:

$$\alpha L=\eta_{OFF}\times(V^2/R-g\times C/G) \quad (2)$$

wherein in the above Equations (1) and (2), $\eta_{ON}$ and $\eta_{OFF}$ denote correction coefficients, V denotes a running speed, R denotes a curvature radius of the track, g denotes a gravitational acceleration, C denotes a cant amount of the track, and G denotes a track gauge.

At this time, the running speed V of the vehicle is usually constant over the entire region of the curved section. Thus, the theoretical excess centrifugal acceleration calculation unit 11 firstly calculates a theoretical excess centrifugal acceleration αL1 in a case of running in the steady-state curve section by the above Equation (1) or (2). In the straight sections before and after the curved section, theoretically speaking, the theoretical excess centrifugal acceleration αL1 does not act on the vehicle and becomes zero. Thus, the theoretical excess centrifugal acceleration calculation unit 11 calculates the theoretical excess centrifugal acceleration αL in a case of running in the easement curve entry section and the easement curve exit section through linear interpolation by using the theoretical excess centrifugal acceleration αL1 of the steady-state curve section for every running distance x1 of the easement curve entry section and for every running distance x2 of the easement curve exit section.

Figure 5:
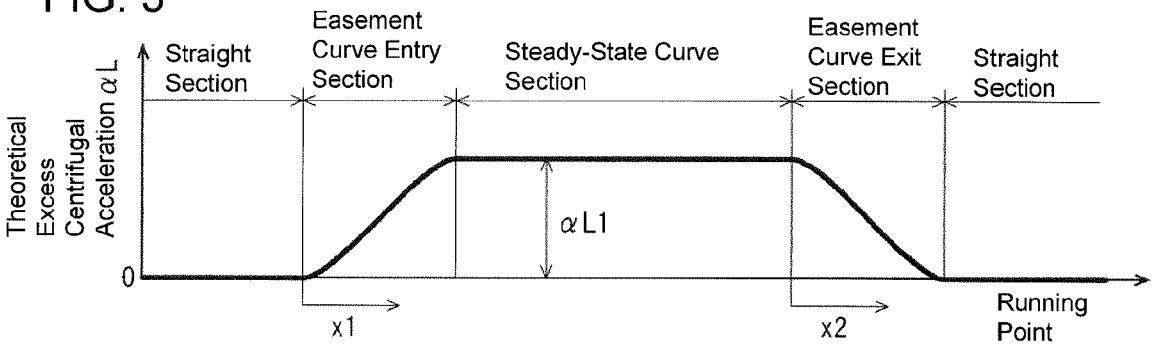
FIG. 5 is a graph showing an example of the behavior of a theoretical excess centrifugal acceleration at the time of running in a curve section.

FIG. 5 is a graph showing an example of the behavior of the theoretical excess centrifugal acceleration at the time of running in a curve section. As shown in the figure, when the vehicle runs in the entire region of the curve section at constant speed, the theoretical excess centrifugal acceleration αL (αL1) is constant in the steady-state curve section, and the theoretical excess centrifugal acceleration αL of the easement curve entry section is increased from zero to the theoretical excess centrifugal acceleration αL1 of the steady-state curve section according to the running distance x1 of the section, and the theoretical excess centrifugal acceleration αL of the easement curve exit section is decreased from the theoretical excess centrifugal acceleration αL1 of the steady curve section to zero according to the running distance x2 of the section.

In such a way, in the case where the railway vehicle runs in a curve section, from the various acquired information (the track information at the running point of the railway vehicle, the running speed V of the railway vehicle, and the ON/OFF information of the vehicle body tilting operation), based on the above Equation (1) or (2), by calculating the theoretical excess centrifugal acceleration αL1 of the steady-state curve section and calculating the theoretical excess centrifugal acceleration αL of the easement curve section with utilizing this result, the theoretical excess centrifugal acceleration αL can be acquired over the entire region of the curve section.

It should be noted that in the above embodiment, the theoretical excess centrifugal acceleration αL of the easement curve section is calculated by using the theoretical excess centrifugal acceleration αL1 of the steady-state curve section. However, the embodiment can be modified so as to determine the curvature radii at respective points of the easement curve entry section and the easement curve exit section and directly calculate the theoretical excess centrifugal accelerations αL in the above sections based on the above Equation (1) or (2).

Here, regarding the above Equations (1) and (2), the correction coefficients $\eta_{ON}$, $\eta_{OFF}$ are coefficients set in consideration of an occasion that the vehicle body 1 tends to tilt (overturn) to the outer rail side of the curved track in association with the deflection of the air cushions 5 and the axle springs 6 by an action of a centrifugal force when the vehicle body 1 and the bogie truck 2 elastically supported onto the axle 3 by the air cushions 5 and the axle springs 6 run in the curve section. Further, the correction coefficient $\eta_{ON}$ among the correction coefficients is a coefficient to be used in the case where the vehicle body tilting operation is turned ON, the coefficient being set by performing a running test in advance so that a vibration suppression effect is almost unchanged even with the above Equation (1) without referring to a vehicle body tilting angle θ.

The correction coefficients $\eta_{ON}$, $\eta_{OFF}$ are given a positive or negative (plus/minus) sign depending on the direction of curvature of the curve section. For example, in the case where the sign of the acceleration detected by the acceleration sensors 9 at the time of running in the curve section with the curvature in the right direction-is positive, each sign of the correction coefficients $\eta_{ON}$, $\eta_{OFF}$ is also positive. On the other hand, at the time of running in the curve section with the curvature in the left direction, the sign of the acceleration detected by the acceleration sensors 9 is negative, and each sign of the correction coefficients $\eta_{ON}$, $\eta_{OFF}$ is also negative. The positive or negative sign of the correction coefficients $\eta_{ON}$, $\eta_{OFF}$ is selected from the track information of the above map in accordance with the running point.

Following such a processing in the theoretical excess centrifugal acceleration calculation unit 11, the above vibration acceleration calculation unit 12 loads the theoretical excess centrifugal acceleration αL calculated by the theoretical excess centrifugal acceleration calculation unit 11 and an acceleration αF in a lateral direction detected by the acceleration sensors 9, and subtracts the theoretical excess centrifugal acceleration αL from the acceleration αF to calculate a difference between both, so that this difference serves as the acceleration of the vibrational component. That is, the vibration acceleration calculation unit 12 removes a steady-state component attributable to the centrifugal force from the acceleration αF acting on the vehicle body 1 when the vehicle runs in the curve section, the acceleration being detected by the acceleration sensors 9, and extracts the acceleration of the vibrational component which is required for the control of the vibration suppression by the operation of the actuator 7.

A signal indicating the vibrational component acceleration calculated by the vibration acceleration calculation unit 12 is output to the above vibration control unit 13, and the vibration control unit 13 sends out the activation signal of extension/retraction motion for suppressing the vibration to the actuator 7 based on the vibrational component acceleration.

Here, the signal indicating the vibrational component acceleration calculated by the vibration acceleration calculation unit 12 often contains noises in a low-frequency bandwidth of 0.5 Hz or less for example although the steady-state component attributable to the centrifugal force is removed. Therefore, it is preferable for the signal indicating the calculated vibrational component acceleration to be processed through a high-pass filter to remove the noises. By removing the noises through the high-pass filter, the vibration suppression in the easement curve entry section and the easement curve exit section in particular can be more stably realized.

As described above, even in the case where the vehicle body tilting is performed by the processing by means of the vibration suppression controller 10 when the railway vehicle runs in the curve section, the equation without referring to the vehicle body tilting angle (the above Equation (1)) is used to determine the theoretical excess centrifugal acceleration for suppressing the vibration generated in the vehicle body in a lateral direction. Thus, in comparison to the equation in the background art (the afore-mentioned Equation (a) disclosed in PATENT LITERATURE 1), the number of parameters can be decreased because the vehicle body tilting angle is not referred to, and the equation can be simplified. Therefore, the capacity of a memory for storing the parameters can be reduced, so that the system for calculating the theoretical excess centrifugal acceleration is simplified. The acceleration of the vibrational component acting on the vehicle body can be precisely derived based on the calculated theoretical excess centrifugal acceleration, and the vibration suppression of the vehicle body can be realized by using the derived acceleration.

INDUSTRIAL APPLICABILITY

According to the vibrational component acceleration estimation device and the vibrational component acceleration estimation method for a railway vehicle of the present invention, the acceleration of a vibrational component acting on a vehicle body in a lateral direction when the railway vehicle having a vehicle body tilting device runs in a curve section can be precisely estimated with a simple system configuration, and the vibration generated in the vehicle body in a lateral direction can be suppressed by using the derived acceleration. Therefore, the present invention is quite useful for comfortable operation of a railway vehicle.

REFERENCE SIGNS LIST

1: Vehicle body
2: Bogie Truck
3: Axle
4: Rail
5: Air cushion
6: Axle spring
7: Actuator
8: Fluid pressure damper
9: Acceleration sensor
10: Vibration suppression controller
11: Theoretical excess centrifugal acceleration calculation unit
12: Vibration acceleration calculation unit
13: Vibration control unit
14: Vehicle body tilting controller
21: Electric motor
22: Main shaft
23: Ball screw nut
24: Rod

What is claimed is:

1. A vibrational component acceleration estimation device for a railway vehicle for estimating the acceleration of a vibrational component acting on a vehicle body in a lateral direction when the railway vehicle having a vehicle body tilting device runs in a curve section, comprising:

an acceleration detection means for detecting the acceleration acting on the vehicle body in a lateral direction;

a theoretical excess centrifugal acceleration calculation means for acquiring track information at a running point of the railway vehicle, a running speed of the railway vehicle, and ON/OFF information of vehicle body tilting operation, and calculating a theoretical excess centrifugal acceleration αL acting on the vehicle body in a lateral direction based on the following Equations (1) or (2); and a vibration acceleration calculation means for deriving the acceleration of the vibrational component acting on the vehicle body based on the acceleration detected by the acceleration detection means and the theoretical excess centrifugal acceleration αL determined by the theoretical excess centrifugal acceleration calculation means, the vibration acceleration calculation means further processing a signal indicating the derived acceleration of the vibrational component through a high-pass filter, in the case where the vehicle body tilting operation is turned ON:

$$\alpha L=\eta hd\ ON\times(V^2/R-g\times C/G) \quad (1)$$

in the case where the vehicle body tilting operation is turned OFF:

$$\alpha L=\eta_{OFF}\times(V^2/R-g\times C/G) \quad (2)$$

where in the above Equations (1) and 2), $\eta_{ON}$ and $\eta_{OFF}$ denote correction coefficients, V denotes a running speed, R denotes a curvature radius of the track, g denotes gravitational acceleration, C denotes a cant amount of the track, and G denotes a track gauge.

2. The vibrational component acceleration estimation device for a railway vehicle according to claim 1, wherein the vibration acceleration calculation means calculates a difference between the acceleration detected by the acceleration detection means and the theoretical excess centrifugal acceleration αL determined by the theoretical excess centrifugal acceleration calculation means to derive the acceleration of the vibrational component.

3. A vibrational component acceleration estimation method for a railway vehicle for estimating the acceleration of a vibrational component acting on a vehicle body in a lateral direction when the railway vehicle having a vehicle body tilting device runs in a curve section, comprising:

an acceleration detection step for detecting the acceleration acting on the vehicle body in a lateral direction;

a theoretical excess centrifugal acceleration calculation step for acquiring track information at a running point, of the railway vehicle, a running speed of the railway vehicle, and ON/OFF information of vehicle body tilting operation, and calculating a theoretical excess centrifugal acceleration αL acting on the vehicle body in a lateral direction based on the following Equation (1) or (2); and a vibration acceleration calculation step for deriving the acceleration of the vibrational component acting on the vehicle body based on the acceleration detected in the acceleration detection step and the theoretical excess centrifugal acceleration αL determined in the theoretical excess centrifugal acceleration calculation step, the vibration acceleration calculation step further including processing a signal indicating the derived acceleration of the vibrational component through a high-pass filter, in the case where the vehicle body tilting operation is turned ON:

$$\alpha L=\eta hd\ ON\times(V^2/R-g\times C/G) \quad (1)$$

in the case where the vehicle body tilting operation is turned OFF:

$$\alpha L=\eta_{OFF}\times(V^2/R-g\times C/G) \quad (2)$$

where in the above Equations (1) and (2), $\eta_{ON}$ and $\eta_{oFF}$ denote correction coefficients, V denotes a running speed, R denotes a curvature radius of the track, g denotes gravitational acceleration, C denotes a cant amount of the track, and G denotes a track gauge.

4. The vibrational component acceleration estimation method for a railway vehicle according to claim 3, wherein in the vibration acceleration calculation step, a difference between the acceleration detected in the acceleration detection step and the theoretical excess centrifugal acceleration αL determined in the theoretical excess centrifugal acceleration calculation step is calculated to derive the acceleration of the vibrational component.

* * * * *